United States Patent [19]

Keiper, Jr.

[11] Patent Number: 4,566,630

[45] Date of Patent: Jan. 28, 1986

[54] BOLTLESS, FRICTION-FIT, ADJUSTABLE RAIL BRACE

[75] Inventor: Tilghman H. Keiper, Jr., Camp Hill, Pa.

[73] Assignee: Bethlehem Steel Corporation, Bethlehem, Pa.

[21] Appl. No.: 602,776

[22] Filed: Apr. 23, 1984

[51] Int. Cl.[4] ..... E01B 9/60; E01B 9/48

[52] U.S. Cl. ..... 238/292; 238/347

[58] Field of Search ..... 238/292, 310, 336, 349, 238/282, 331, 347

[56] References Cited

U.S. PATENT DOCUMENTS

| | | | |
|---|---|---|---|
| 2,504,475 | 4/1950 | Vickroy | 238/336 |
| 2,600,183 | 6/1952 | Arnold et al. | 238/292 |
| 2,636,687 | 4/1953 | Arnold et al. | 238/336 |
| 2,904,256 | 9/1959 | Devaney, Jr. | 238/336 X |
| 3,292,857 | 12/1966 | Hughes | 238/292 X |
| 3,881,652 | 5/1975 | Jacobson | 238/349 |
| 4,119,271 | 10/1978 | Campbell | 238/336 |
| 4,306,677 | 12/1981 | Fischer | 238/349 |

FOREIGN PATENT DOCUMENTS

| | | | |
|---|---|---|---|
| 579699 | 7/1958 | Italy | 238/349 |

*Primary Examiner*—Robert B. Reeves
*Assistant Examiner*—David F. Hubbuch
*Attorney, Agent, or Firm*—John I. Iverson

[57] ABSTRACT

A boltless, friction-fit adjustable brace for bracing rails on a tie plate wherein a plurality of friction surfaces of a removable side brace engage corresponding surfaces on a rail. The brace is provided with a serrated portion on its side for engagement with a serrated washer, which washer has a pair of ear lugs which span and contact a mounting plate on the tie plate. Finally, a resilient spring clip is applied thereto to engage the serrated washer, to prevent longitudinal, lateral and elevational movement of the side brace, when the rails are under load.

4 Claims, 6 Drawing Figures

BOLTLESS, FRICTION-FIT, ADJUSTABLE RAIL BRACE

FIELD OF THE INVENTION

This invention relates to the area of rail securing means, and more particularly to an adjustable means for bracing rails without the use of bolts.

BACKGROUND OF THE INVENTION

It is well known that occasionally, rails must be braced so as to prevent movement thereof, as a railroad car passes thereon. Most typical bracing devices employ elements which require nuts and bolts for anchoring. One such bracing device is shown in U.S. Pat. No. 3,295,761 to Marcin, wherein bolts are required to anchor a bracing member to a tie-plate. Other such devices are shown in U.S. Pat. Nos. 2,904,256 to Devaney and 3,292,857 to Hughes. Each such device requires the use of bolts and nuts for anchoring.

The use of bolts and nuts is a problem in that bolts can be stripped, alignment of bolts and bolt holes takes time and wrenches are required.

There is a need, therefore, for a heavy duty adjustable brace which can be assembled without the use of bolts and nuts, thus avoiding the problems described above.

SUMMARY OF THE INVENTION

This invention provides the adjustable brace which solves the problems described above. The brace of this invention includes a boltless, friction-operated adjustable side brace having a plurality of friction surfaces for engaging a rail and a tie plate. A stop block is diagonally affixed to a tie plate and frictionally engages the side brace. A serrated portion on the side brace interference—fits with a serrated washer that has ear lugs which span and contact a mounting plate on the tie plate, which mounting plate holds a resilient spring clip that holds together the stop block and side brace.

DESCRIPTION OF PREFERRED EMBODIMENT AND BEST MODE

Figure 1:
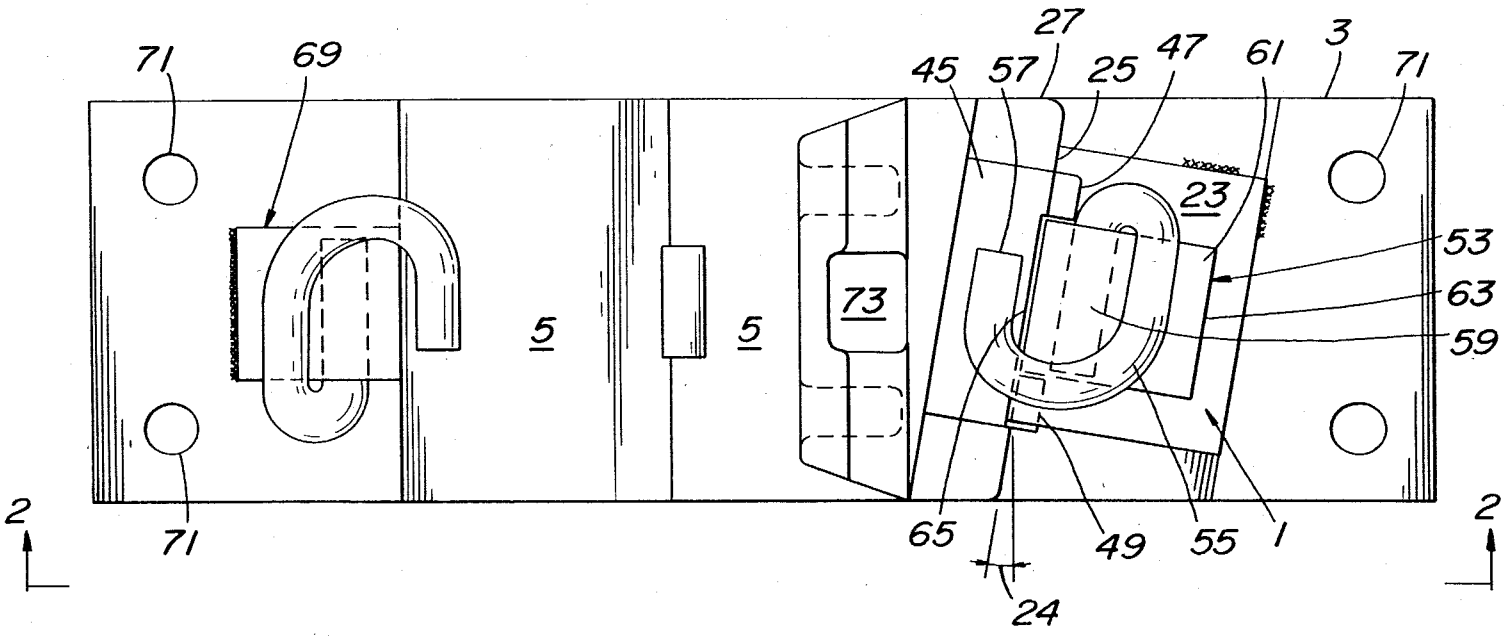
FIG. 1 shows a plan view of the adjustable friction brace of this invention.
Figure 2:
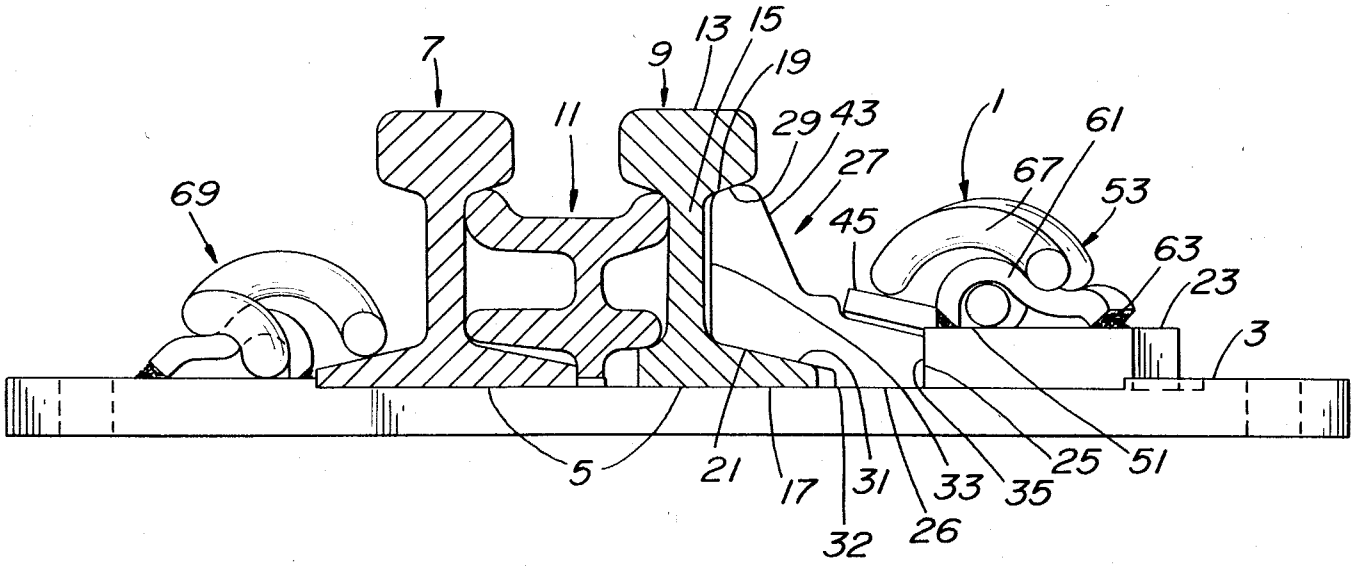
FIG. 2 is a view along line 2—2 of FIG. 1 showing the rails to be braced in cross section.
Figure 3:
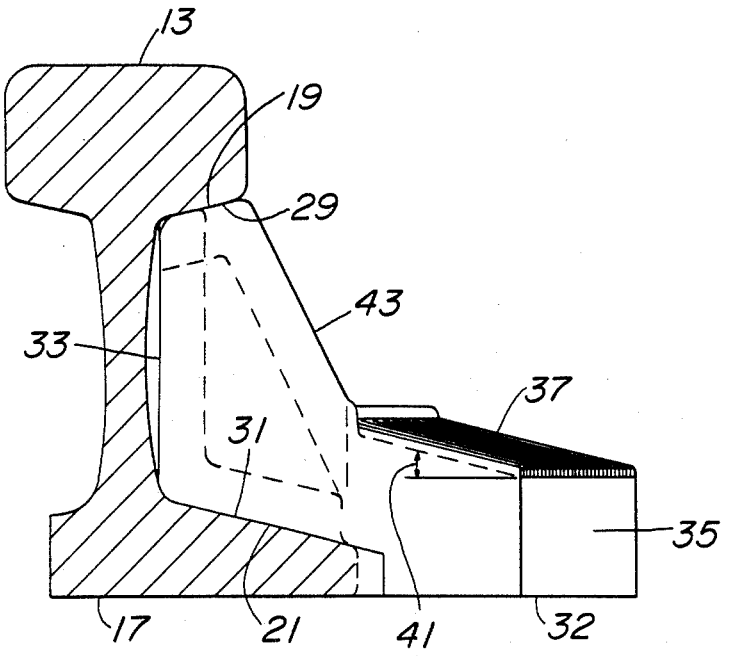
FIG. 3 is an enlarged cross sectional elevational view of the brace, with other portions of the device removed.
Figure 6:
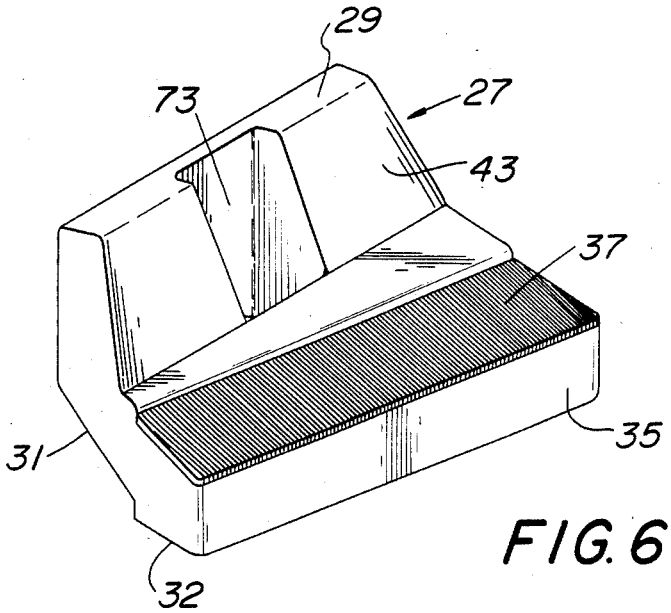
FIG. 6 is an isometric view of the removable side brace used in the invention.
Figure 5:
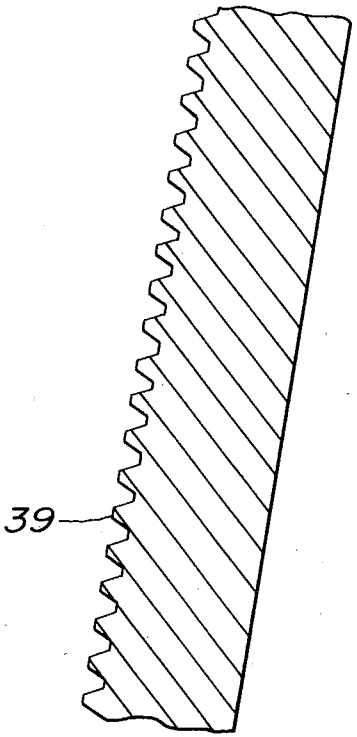
FIG. 5 is a section along line 5—5 of FIG. 4.
Figure 4:
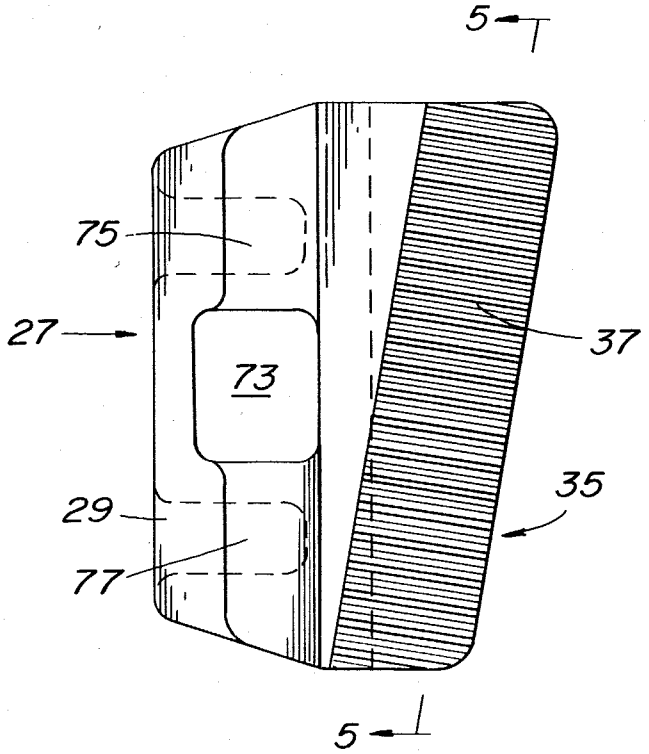
FIG. 4 is a plan view of the removable side brace used in the invention.

Referring to FIG. 1 and FIG. 2, there is shown the brace 1 of this invention. Cross tie plate 3 has beds 5 extending longitudinally thereacross. Beds 5 carry spaced, parallel rails 7 and 9 as well as separator 11 all shown in cross section.

Rail 9 is the rail to be contacted by the brace of this invention and will be described in more detail. Rail 9 includes head 13, web 15, and base 17 all of conventional design. Connecting head 13 and web 15 is curved portion referred to herein as fishing area 19. Connecting web 15 with base 17 is angled flange portion 21, as as is well known.

Affixed to tie plate 3 is stop 23 extending horizontally longitudinally of tie plate 3 as shown in FIG. 1. As shown in FIG. 2, stop 23 includes upstanding front frictional surface 25 which extends longitudinally of tie plate 3 but is angled toward bed 5, as shown in FIG. 1. The degree of angle is not critical, but I prefer an angle 24 of 10°, transverse to tie plate 3. Adjacent to upstanding surface 25 is a generally horizontal frictional surface 26 on tie plate 3, which frictional surface extends parallel to front surface 25.

Frictionally fitted between stop 23 and rail 9 is adjustable side brace 27. Side brace 27 includes top frictional surface 29, shaped to conform to fishing area 19 and adapted to contact frictionally against the fishing area as will be hereinafter explained. Side brace 27 also includes bottom slanted frictional surface 31 contacting flange portion 21. Bottom surface 31 steps downwardly to form generally horizontal frictional surface 32 which frictional surface extends parallel to and frictionally engages surface 26 of tie plate 3. Back portion 33 connects top and bottom surfaces 29 and 31. Side brace 27 further includes upstanding front frictional surface 35 extending longitudinally of tie-plate 3, and being parallel to and, in frictional contact with, stop front frictional surface 25.

Thus, it can be understood that frictional surfaces 25, 26 on stop 23 and tie plate 3 are generally at right angles with each other, but could be slightly angularly oriented toward each other also. Likewise, corresponding surfaces 32, 35 on side brace 27 are also generally at right angles to each other, so as to match up with surfaces 25, 26. If surfaces 25, 26 are angled to each other, surfaces 32, 35 are are likewise angled to each other.

Located on side brace 27 is a serrated face portion 37 extending longitudinally of tie plate 3 and parallel to front brace friction surface 35. Serrated face portion 37 carries a plurality of teeth 39, which teeth are generally perpendicular to front friction surface 35. Serrated face portion 37 is angled at angle 41, about 13° from horizontal. Angle 41 could be different, including a zero angle (horizontal).

Angling upwardly from serrated face portion 37 is front surface 43 to top frictional surface 29.

Positioned onto serrated face portion 37 is serrated washer 45 carrying teeth which interlock with teeth 39, to provide interference fit between washer 45 and serrated face portion 37. Serrated washer 45 includes a first and second ear lug 47 and 49 (FIG. 1) respectively, which ear lugs extend over the top surface 51 of stop block 23.

A removable spring clip means shown generally as 53 is affixed to stop block 23, as by welding. The spring clip means is positioned between, and in contact with, ear lugs 47, 49, as shown in FIG. 1. Spring clip means 53 includes resilient, one-piece, metal bar 55 bent or formed in a curved shape such that one section 57 contacts washer 45 and a second section 59 is held against top surface 51 of stop block 23 by mounting plate 61 which is welded at each end 63, 65 to stop block 23. A curved bar portion 67 extends between ends 57, 59 in a configuration to permit second section 59 to be frictionally forceably inserted into contact with and under curved portion of mounting plate 61, as by means of a sledge hammer. The design of spring clip means 53 is conventional and, such spring clips are well known, and could include a so-called Pandrol clip. See U.S. Pat. No. 3,910,493.

Also shown in FIGS. 1 and 2 is a second clip means 69, of conventional design, holding down rail 7. A second device of the invention could also be used in place of clip means 69. Finally, holes 71 are shown for mounting tie plate 3 to cross ties (not shown) as is well known.

Front surface 43 of brace 27 includes depressions 73 representing excess metal removed for reduction in weight. Back surface 33 includes depressions 75, 77 also for reduction in weight.

All frictional surfaces 29, 31, 32 and 35 on side brace 27 can be provided with suitable grooves or serrations to enhance the ability of each surface to frictionally engage a corresponding surface on the rail or tie plate.

Also, the brace of this invention could be used to brace a single rail on one or on both sides thereof.

OPERATION

In order to brace rails 7 and 9, side brace 27 is inserted between stop block 23 and rail 5 and hammered into frictional engagement, such that top surface 29 frictionally engages fishing area 19, slanted bottom surface 31 frictionally engages flange 21, horizontal surface 32 frictionally engages surface 26 and front surface 35 frictionally engages front surface 25 of stop block 23.

Serrated washer 45 is placed onto serrated face portion 37 of brace 27 such that mating serrations provide an interference fit, and ear lugs 47, 49 span and contact attachment plate 61. Resilient spring clip 55 is driven into position wherein end 59 is force fit into mounting plate 61. By reason of friction fit, interference fit and ear lugs as herein described brace 27 is prevented from moving longitudinally and laterally of tie plate 3. By means of spring clip 53 and lugs 47, 49 extending over top portion surface 51 of stop block 23, brace 27 is prevented from elevational movement, i.e. raising up. Such benefits are provided without use of bolts, as required by comparable prior art devices.

I claim:

1. A boltless, friction-operated, adjustable brace for bracing a single rail or a pair of parallel, spaced-apart rails, the brace, in combination, comprising:

(a) a tie plate having a bed longitudinally crossing the tie plate, for carrying the rails;

(b) a stop block affixed to the tie plate adjacent the bed, the stop block having an upstanding front frictional surface extending longitudinally of the tie plate and angled toward the bed;

(c) the tie plate having a horizontal frictional surface adjacent to the upstanding front frictional surface of the stop block; and (d) a removable side brace contacting one of the rails, the side brace having:

(i) means for frictionally engaging the rail, said means including a top surface for frictionally engaging a fishing area on a rail, and a slanted bottom surface for frictionally engaging a flange portion on a rail;

(ii) means for frictionally engaging the tie plate, said means including an upstanding front surface extending longitudinally of the tie plate, the surface extending parallel to and frictionally engaging the stop block front frictional surface; and a horizontal bottom surface extending longitudinally of the tie plate, the surface extending parallel to and frictionally engaging the tie plate horizontal frictional surface;

(iii) means for interference engagement between the side brace and the stop block; and (e) spring clip means for resiliently holding the side brace and stop block together.

2. The invention of claim 1 in which the means for interference engagement includes:

(a) a serrated face portion extending longitudinally of the tie plate and parallel to the front frictional surface of the side brace; and (b) a removable serrated washer interference—fit onto the serrated face portion, the washer having a pair of spaced apart ear lugs extending over the top surface of the stop block.

3. The invention of claim 2 in which the spring clip means includes a removable spring clip on the stop block, and a mounting plate positioned between and contacting the spaced apart ear lugs of the serrated washer.

4. A boltless, friction-operated, adjustable brace for bracing a pair of parallel, spaced-apart rails, with a separator therebetween, each rail having a head portion, a web portion, a fishing area connecting the head and web portions, a base, and an angled flange portion connecting the web and base portions; the brace, in combination, comprising:

(a) a tie plate having a bed longitudinally crossing the tie plate, for carrying the pair of rails and separator;

(b) a stop block affixed to the tie plate adjacent the bed, the stop block having an upstanding front frictional surface extending longitudinally of the tie plate and angled toward the bed;

(c) the tie plate having a horizontal frictional surface adjacent to the upstanding surface of the stop block;

(d) a removable side brace contacting one of the rails, the side brace having:

(i) a top surface for frictionally engaging the fishing area;

(ii) a slanted bottom surface for frictionally engaging the flange portion;

(iii) a horizontal bottom surface for frictionally engaging the tie plate horizontal frictional surface;

(iv) a back portion connecting said top and slanted bottom frictional surfaces;

(v) an upstanding, front surface extending longitudinally of the tie plate, the surface parallel to and frictionally engaging the stop block front frictional surface;

(vi) a serrated face portion extending longitudinally of the tie plate and parallel to the front frictional surface; and (vii) a front surface angled upwardly between the face portion and top frictional surface;

(e) a removable serrated washer interference-fit onto the serrated face portion, the washer having a pair of spaced-apart ear lugs extending over the top surface of the stop block; and (f) a removable spring clip means on the stop block, positioned between and contacting the spaced ear lugs, for preventing the washer from raising and for preventing the side brace from moving longitudinally or laterally of the tie plate.

* * * * *